United States Patent [19]

Gallus et al.

[11] 4,135,673

[45] Jan. 23, 1979

[54] METHOD OF AVOIDING OR PREVENTING LOW-ORDER RIBBON WINDINGS IN THE WINDING OF FILAMENTS

[75] Inventors: Manfred L. Gallus; Hermann-Josef Stupp, both of Dormagen, Germany

[73] Assignee: Bayer Aktiengesellschaft, Leverkusen, Germany

[21] Appl. No.: 768,575

[22] Filed: Feb. 14, 1977

[30] Foreign Application Priority Data

Feb. 17, 1976 [DE] Fed. Rep. of Germany ..... 2606208

[51] Int. Cl.[2] ..... B65H 54/38

[52] U.S. Cl. ..... 242/18.1

[58] Field of Search ..... 242/18.1, 43 R, 174–176, 242/177, 178

[56] References Cited

U.S. PATENT DOCUMENTS

| | | | |
|---|---|---|---|
| 3,235,191 | 2/1966 | Engelman et al. | 242/18.1 |
| 3,241,779 | 3/1966 | Bray et al. | 242/18.1 |
| 3,638,872 | 2/1972 | Jennings | 242/18.1 |
| 3,741,491 | 6/1973 | Richter | 242/18.1 |
| 3,799,463 | 3/1974 | Peckinpaugh | 242/18.1 |
| 3,910,514 | 10/1975 | Hooper | 242/18.1 |

*Primary Examiner*—Stanley N. Gilreath

*Attorney, Agent, or Firm*—Plumley and Tyner

[57] ABSTRACT

A winding process for producing cheeses and cones for natural or synthetic drawn or undrawn filaments, wherein by controlling the traversing frequency DH of the traversing thread guide as a function of time or the radius of the cheese or the rotational speed of the cheese or equivalent parameters are at a constant ratio m'/k', where k' is the order of the ribbon winding and m' is the corresponding number of revolutions of the cheese, ribbon windings of the order k'>2 are exclusively produced.

5 Claims, 2 Drawing Figures

METHOD OF AVOIDING OR PREVENTING LOW-ORDER RIBBON WINDINGS IN THE WINDING OF FILAMENTS

This invention relates to a method of producing cross-wound cheeses, cones or parallel bobbins from natural or synthetic, drawn or undrawn filaments, in which the formation of low-order ribbon windings is avoided or reduced.

So-called random wound cheeses are known in which image windings occur at certain diameters, i.e. the mutual position of individual filaments changes from layers in which the filaments are neither parallel nor situated one above the other to layers in which the filaments are parallel to and situated above one another.

In so-called precision wound cheeses, the filaments lie adjacent one another by virtue of the linear winding ratio and the $\theta$ -value and the filaments of every second layer are parallel to one another.

If the arrangement of individual filaments relative to one another is observed, a certain similarity is found between the ribbon windings in random-wound cheeses and precision-wound cheeses. Both in random winding and also in precision winding, the filaments of every second layer are parallel to one another in the most simple case. In the case of precision-wound cheeses, the intervals between the centres of two adjacent filaments are displaced relative to one another by the $\theta$ -value to such an extent that, although they are parallel to one another, they are not situated above one another. In the case of a ribbon winding, the filaments of every second layer are parallel to and above one another in the most simple case. However, this layer structure, characteristic of random wound cheeses, may be regarded as theoretically simplified by comparison with practice because, in addition to layers of filaments lying parallel to and above one another, there are also layers which lie parallel to and adjacent one another both on account of the continuous change in the diameter of the cheese during winding and on account of slipping or sliding of the individual layers or turns of filaments.

The precision wound cheese may be regarded as homogeneous. A random wound cheese may be regarded as inhomogeneous when the zones with and without image winding are compared with one another. This inhomogeneity is responsible for the fact that, in random wound cheeses, individual zones of the cheese can be displaced relative to one another, especially when certain properties of the filament vary over the length of the filament. This is generally the case in practice.

By "ribbon" is meant yarn laid down substantially on top of or along the same path as the previously wound yarn. This repeated duplication of yarn path on the package creates a ridge or ribbon on the package, causing an out-of-round package, bouncing winder chucks, causing heavy traverse motor loads, and yarn damage.

In order to avoid the adverse effects of ribbon windings, so-called pattern repeat elimination devices or ribbon formation eliminators are used in practice. For example, an interfering frequency is superimposed upon the constant traversing frequency. Although ribbon formation eliminators such as these improve the cohesion of the cheese, they do not avoid the ribbon windings. The ribbon windings are merely distributed over a wider area.

Cheeses with a disturbed random winding have a sufficiently firm structure, even in the case of smooth man-made filaments. Unfortunately, the offwinding properties of cheeses such as these are extremely unsatisfactory at high overhead offwinding speeds, for example in excess of 400 m/minute. This is particularly the case in processes where the filament is subjected to mechanical and/or thermal stressing, for example during cold drawing, hot drawing, draw-texturing (simultaneous or consecutive) or fixing. Thus, corresponding tests in which the filament was offwound overhead at high speeds from a cheese with a disturbed random winding, showed that the frequency of filament breakages is particularly high at certain cheese diameters.

An object of the present invention is to obviate the disadvantages referred to above, i.e. to produce cheeses of which the offwinding properties are satisfactory, even at high offwinding speeds. According to the invention, this object is accomplished by a winding process for producing cheeses and cones for natural or synthetic, drawn or undrawn filaments wherein by controlling the traversing frequency DH of the traversing thread guide as a function of time or the radius of the cheese or the rotational speed of the cheese or equivalent parameters at a constant ratio $m'/k'$, where $k'$ is the order of the ribbon winding and $m'$ is the corresponding number of revolutions of the cheese, ribbon windings of the order $k' > 2$ are exclusively produced. In other words, this process controls the traversing frequency DH to maintain the ratio $k'/m'$ at a constant value, the control being exercised by setting the length of time of a traverse cycle, setting the radius of the cheese, setting the rotational speed of the cheese, or setting other equivalent variables, such as the volume of the cheese or the amount of filament on the cheese.

In order to explain the parameters used to characterise the process, the considerations which resulted in the discovery of the method according to the invention are discussed in detail in the following.

Figure 1:
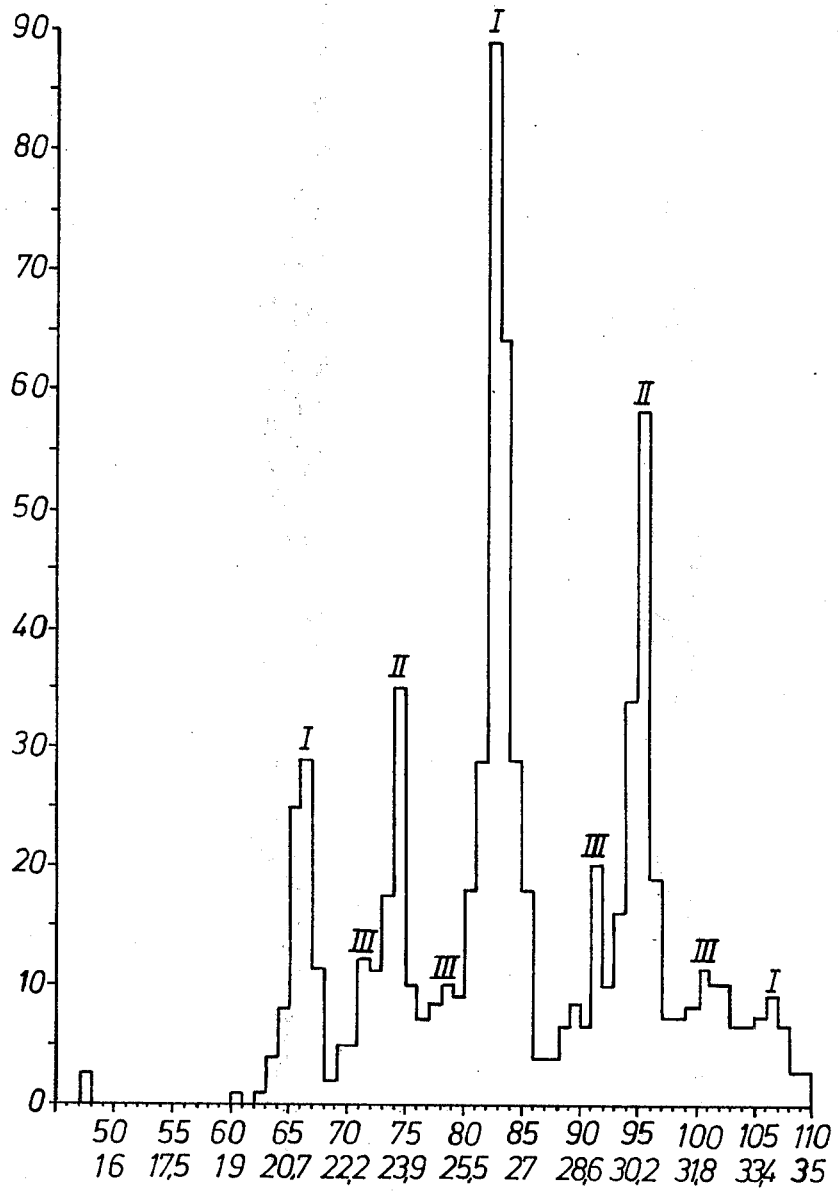
FIG. 1 graphically illustrates the number of filament breakages as a function of bobbin diameter or circumference in centimeters for a series of ribbon windings wherein the order of the winding is indicated by Roman numerals.

Hitherto, it has been assumed in the literature that ribbon windings occur at diameters at which the rotational speed of the bobbin is a whole multiple of the traversing frequency of the traversing filament guide in accordance with the following expression:

$$v/2\pi r = n \cdot DH \quad (1)$$

in which:

$v$ = linear winding speed of the bobbin in cm/minute $r$ = radius of the bobbin during winding in cm DH = number of double traversing lifts or strokes, (i.e. traversing frequency)

$n = 1, 2, 3 \ldots$ integral number of the revolutions of the bobbin per double pass.

In an exact analysis of the number of filament breakages as a function of the bobbin or cheese diameter in the case of crosswound cheeses with known ribbon formation eliminators (see for instance German OS No. 2.319.282 or U.S. Pat. Nos. 3,638,872 and 3,241,779) our own investigations lead to the surprising conclusion that the diameters at which filament breakages occur with particularly high probability as a result of distrubances in the offwinding properties may be calculated in accordance with the following expression:

$$v/2\pi r = m/k \cdot DH \quad (2)$$

$k = 1, 2, 3, \ldots$
$m = k, k+1, k+2, \ldots, nk, \ldots$

Where $k = 1$ and n is a multiple of k, (2) changes into (1).

If the ratio m/k is shortened to m'/k', k' indicates the number of double passes after which the filament is again laid parallel to and over a filament of a preceding layer. m' indicates the corresponding number of revolutions of the cheese.

The integral component of the improper fraction m'/k' or m/k indicates the series of the ribbon windings.

The number of double passes k' passes until the next parallel and vertically adjacent filament is laid is known by definition as the order of the ribbon winding.

(2 k' − 1) indicates the number of layers of filament between two parallel and vertically adjacent filaments.

Accordingly, it may be concluded from the experimental data that the probability of filament breakages at a given offwinding speed and for a given type of winding decreases with increasing order and possibly also with increasing series of the ribbon winding. If the number of filament breakages is plotted against the corresponding diameter of the bobbin or cheese, it can clearly be seen that, at certain diameters of the cheeses, an accumulation of filament breakages occurs. A graph such as this is shown for example in FIG. 1 where the number of breaks is plotted on the ordinate and the diameters or circumferences of the bobbins in cm on the abscissa. The roman numerals denote the order of the ribbon windings.

Taking into account the increase in the diameter of the cheeses by about 3% both during winding and during the standing time, comparison of the filament break diameters observed with the ribbon winding diameters calculated in accordance with formula (2) shows a clear consistency.

In the context of the method according to the invention, the winding operation is described by the mathematical function $$F(DH, m'/k', v, r \text{ or } t) = 0 \quad (3)$$

wherein here and elsewhere in the specification F means "function of " and the portion in parentheses means DH or $m^1/k^1$ or y or r or t. The symbols DH, $m^1/k^1$, v, and r are as defined above, and t is the winding on time.

The bobbin radius and winding-on time are functionally interrelated. It follows from this that the winding operation is described by the function $$F(DH, m'/k', r, v) = 0 \quad (4)$$

or by the function $$F(DH, m'/k', t, v) = 0 \quad (5)$$

In the interests of simplicity, discussion is confined in the following to the function (4) because the same considerations apply to both functions (4) and (5).

Of the three variables DH, m'/k' and r, the bobbin radius r cannot be regarded as independent because the change in r takes place as a result of a certain winding operation.

Of the two variables DH and m'/k', only one can be selected as an independent variable, for example DH, so that the other variable m'/k' automatically becomes the dependent variable.

Figure 2:
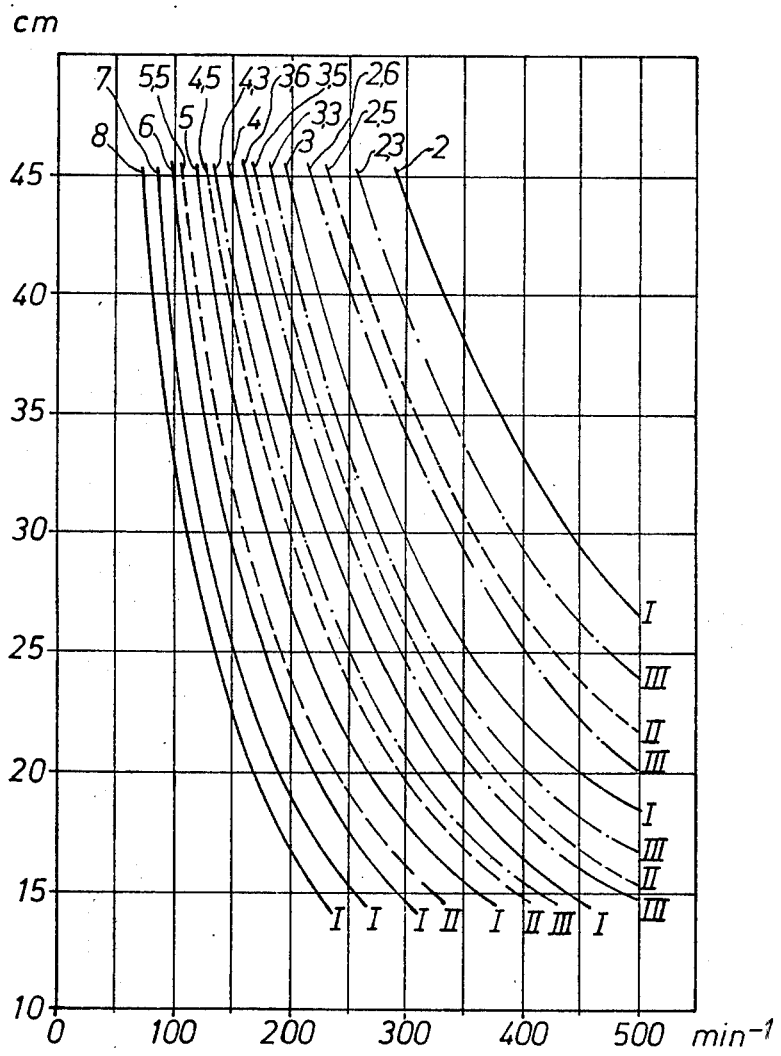
FIG. 2 graphically illustrates traversing frequency in double passes per minute as a function of bobbin diameter in centimeters for a series of ribbon windings wherein the order of the winding is indicated by Roman numerals.

For a certain winding speed (in FIG. 2 840 m/min$^{-1}$ corresponding to Example 1), the function $$F(DH, m'/k', r, v) = 0 \quad (4)$$

in the two-dimensional representation gives hyperbolae with the representation parameter m'/k' . Hyperbolae such as these are shown in FIG. 2. The double passes DH (traversing frequency) in min$^{31\ 1}$ are shown on the abscissa and the bobbin diameter in cm on the ordinate (wherein cm equal centimeters and min$^{31\ 1}$ 1/minutes). The roman numerals in FIG. 2 denote the order of the ribbon windings. The parameter of the representation is m'/k' .

At bobbin diameters which correspond to the intersections of the hyperbolae with the straight line DH = const. (in FIG. 2 for example DH = 260 min$^{31\ 1}$), ribbon windings occur which lead with particularly high probability to offwinding difficulties and hence to filament breakages. The offwinding difficulties are particularly conspicuous at high offwinding speeds of the filament from the cheese (see Example 2).

It follows from the tests conducted and also from the explanations given above that low-order ribbon windings lead to offwinding difficulties (filament breakages) with greater probability than ribbon windings of relatively high order.

Low-order ribbon windings which lead to poor offwinding (filament breakages) with high probability are avoided in the method according to the invention by virtue of the fact that the traversing frequency is controlled in such a way that a ribbon winding of high (constant) order is always formed. In other words, the traversing frequency is controlled in accordance with a hyperbola function $$DH = F(r) = v/2\pi r \cdot m'/k' \quad (6)$$

in which $k' > 2$ and in accordance with well known principles of differential calculus where d means "differential of" (d (m'/k'/dr) = 0, i.e. m'/k'= const.

The absolute position of the hyperbola is determined by the spinning take-off rate and the technical requirements of the winding unit, by the strength of the material to be wound and also by the required size of the cheeses.

A hyperbola at high traversing frequencies of the filament guide member is particularly favourable because in that case the interval between two successive ribbon winding diameters of the first order is relatively great.

Since a number of winding machines are available on the market, the limiting conditions have to be worked out in practice in each case.

The traversing frequency of the filament guide member controlled or regulated in accordance with the invention preferably has an interfering function of relatively low frequency and/or amplitude superimposed on it. The interfering function may be kept constant throughout the duration of the winding operation or may be a function of time, the radius of the cheese or an equivalent parameter.

In cases where cheeses with considerable differences between the final radius and the initial radius are produced by the method according to the invention, it may be necessary, in order to obtain cheeses with a sufficiently firm structure, to keep the winding tension between the filament guide member and the package constant as a function of time. In the case of considerable differences in radius, it is advisable to apply an automatic regulation, whereas in the event of relatively small differences in radius, it is sufficient for the winding tension between the traversing filament guide member and the package to be readjusted in stages by hand.

The filament tension is best regulated or controlled in such a way that it increases with decreasing traversing frequency and decreases with increasing traversing frequency.

EXAMPLE 1

Polyamide-6 (final denier dtex 44 f 9 which means a yarn of 9 filaments having a mass of 44 decigrams per kilometer) spun at 840 m/min was wound into a cheese with the filament guide member traversing at 260 double passes per minute.

The full cheese weighed 6300 g. After a certain standing period, the filaments on the cheeses were drawn, the offwinding speed of the filaments from the cheeses amounting to 750 m/min. Two cops of drawn filament each weighing 3100 g are produced from one cheese (6300 g). The yield (first and second drawing take-off together) of cops of full drawn filament, based on the number of possible cops of full drawn filament, amounted to 55%.

If the number of filament breakages is plotted against the corresponding bobbin diameter, it can clearly be seen that an accumulation of filament breakages occurs at certain diameters of the cheeses (FIG. 1).

Taking into account the increase in the diameter of the cheeses by about 3% both during winding and during the standing period, comparison of the filament break diameters observed with the ribbon winding diameters calculated in accordance with formula (2) shows a distinct consistency.

| Diameter of the cheeses | | | | k' = order of the |
|---|---|---|---|---|
| observed | calculated | k | m | ribbon winding |
| 20.6 | 21.6 | 2 | 10 | 1 |
| 22.1 | 22.8 | 3 | 14 | 3 |
| 23.0 | 23.7 | 2 | 9 | 2 |
| 23.7 | 24.4 | 3 | 13 | 3 |
| 25.7 | 26.5 | 2 | 8 | 1 |
| 28.1 | 28.9 | 3 | 11 | 3 |
| 29.5 | 30.4 | 2 | 7 | 2 |
| 30.9 | 31.9 | 3 | 10 | 3 |
| 34.4 | 35.4 | 2 | 6 | 1 |

EXAMPLE 2 (Comparison Example)

Polyamide-6 (final denier dtex 44 f 10) spun at 800 m/min was wound into cheeses with the filament guide member traversing at a constant rate of 320 double passes per minute.

The full cheeses weighed 8500 g. After a certain standing period, the filaments on the cheeses were drawn, the offwinding speed of the filament from the cheeses amounting to 250 m/min (a) and 800 m/min (b). Three cops of drawn filament each weighing 2800 g were to be produced from one cheese.

The yield (first, second and third drawing take-off together) of cops of full drawn filament, based on the number of possible cops of full drawn filament, amounted to 95% in case (a) and to between 1.6 and 72% in case (b), depending upon the hardness of the package.

EXAMPLE 3

Polyamide-6 (final denier dtex 44 f 10) spun at 800 m/min was wound into cheeses with the filament guide member traversing at a controlled rate. The traversing of the filament guide member was controlled as a function of the rotational speed U of the cheese:

$$DH = k'/m' \cdot U$$

$$U = V/2\pi r$$

$$m'/k' = \text{const.} = 2.75$$

At the beginning of the winding operation, the traversing frequency of the filament guide member amounted to 600 double strokes per minute. The full cheeses weighed 8500 g.

After a certain standing period, the filaments on the cheeses were drawn, the offwinding speed of the filament from the cheeses amounting to 800 m/min.

Three cops of drawn filament each weighing 2800 g were to be produced from one cheese.

The yield (first, second and third drawing take-off together) of cops of full drawn filament, based on the number of possible cops of full drawn filament, amounted to 89%.

What is claimed is:

1. In a winding process for the production of cheeses and cones of natural or synthetic, drawn or undrawn filaments wherein the filaments are wound onto a rotating bobbin guided by a traversing filament guide member, the improvement comprising producing exclusively ribbon windings of the order $k' > 2$ by controlling the traversing frequency DH of the guide member as a function of time or the radius of the cheese or the rotational speed of the cheese or an equivalent parameter at a constant ratio $m'/k'$, where $k'$ is the order of the ribbon winding and $m'$ is the corresponding number of revolutions of the cheese.

2. A process as claimed in claim 1, wherein an interfering function of relatively low frequency or amplitude or both of the traversing filament guide is superimposed upon the controlled traversing frequency of the traversing filament guide.

3. A process as claimed in claim 2, wherein the interfering function is kept constant throughout the duration of the winding process.

4. A process as claimed in claim 2, wherein the interfering function is a function of time or of the radius of the cheese or of an equivalent parameter.

5. Cheeses when produced by a process as claimed in claim 1.

* * * * *